US005736661A

United States Patent [19]

Armstrong

[11] Patent Number: 5,736,661

[45] Date of Patent: Apr. 7, 1998

[54] SYSTEM AND METHOD FOR TUNING AN INSTRUMENT TO A MEANTONE TEMPERAMENT

[76] Inventor: Paul R. Armstrong, 275 S. Drummond St., Bourbonnais, Ill. 60914

[21] Appl. No.: 615,153

[22] Filed: Mar. 12, 1996

[51] Int. Cl.[6] ..... G10G 7/02

[52] U.S. Cl. ..... 84/454; 84/477 R; 84/456

[58] Field of Search ..... 84/454, 477 R, 84/347, 349, 456, 348

[56] References Cited

U.S. PATENT DOCUMENTS

| | | | |
|---|---|---|---|
| 1,680,039 | 8/1928 | Hammond, Jr. | 84/338 |
| 4,296,667 | 10/1981 | Wade et al. | 84/345 |
| 4,361,069 | 11/1982 | Peterson et al. | 84/346 |
| 5,315,161 | 5/1994 | Robinson et al. | 307/66 |
| 5,501,130 | 3/1996 | Gannon et al. | 84/454 |

*Primary Examiner*—Cassandra Spyrou
*Assistant Examiner*—Shih-yung Hsich
*Attorney, Agent, or Firm*—Sawyer & Associates

[57] ABSTRACT

The meantone temperer external device is used in conjunction with a keyboard or other musical instrument. The meantone temperer is used to temper the connected musical instrument to any desired meantone-tempered scale, which is selected by the user. This device is operated by simply entering the desired temperament on the input keypad and pressing the "temper" button. Calculations are then made and the results are stored in RAM. When the user strikes a note on the musical instrument, a value is pulled out of RAM corresponding to the note struck. This value is then multiplied by the corresponding octave multiplier in ROM and the tempered note is sounded.

16 Claims, 3 Drawing Sheets

SYSTEM AND METHOD FOR TUNING AN INSTRUMENT TO A MEANTONE TEMPERAMENT

FIELD OF THE INVENTION

The present invention relates to tuning a musical instrument and more particularly to tuning a musical instrument in accordance with the meantone of such an instrument.

BACKGROUND OF THE INVENTION

Musical instruments are tuned in a variety of manners. For example, a typical tuning for an instrument is through an equal temperament arrangement in which each of the notes in a particular device is equally spaced apart in frequency.

Another type of tuning is tuning in accordance with the meantone scale. This type of tuning has been utilized typically to precisely tune a particular instrument to a particular type of user. Hence, for example, many of the great classical composers' music are played utilizing instruments that have been tuned in accordance with the meantone temperament to provide music which is precisely tuned to the particular music being played.

Typically such meantone tuning is accomplished, for example, in a wind instrument, such as a flute or the like, by drilling holes in precise spots within the wind instrument to provide the proper tonal quality. In another example, a piano would be tuned by providing specific adjustments to the piano for the particular song or set of songs being played. Up until the present time, to provide this type of tuning required physical modification of the particular instrument to ensure that particular instrument has the proper tonal qualities.

For electronic devices such as a MIDI device and the like, this meantone tempering has heretofore not been utilized because of the physical modification required of such devices. Accordingly, what has been typically done is to tune many devices and the like utilizing an equal temperament, thereby not ensuring the tonal quality that be obtained utilizing a mean tone temperament type device.

Accordingly, what is needed is a system for allowing for electronic musical devices to be tuned in accordance with meantone temperament arrangements. The system should be simple and easily adaptable to such systems and should be cost effective. The present invention addresses such a need.

SUMMARY OF THE INVENTION

A system for tuning an instrument to a meantone temperament comprising an input key pad for providing a desired meantone temperament; a computation means for receiving the desired temperament and for providing exploded digital data representative of a cycles per second of the desired meantone temperament; a memory means for receiving the exploded data from the computation means; and a processing unit coupled to the memory means and the instruments for processing, relaying and routing data to and from the musical instrument.

DESCRIPTION OF THE INVENTION

The present invention relates to an improvement in tuning a musical instrument. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

The meantone temperer external MIDI device is used in conjunction with a MIDI keyboard or other MIDI musical instrument. The meantone temperer is used to temper the connected musical instrument to a desired meantone-tempered scale, which is selected by the user. This device is operated by simply entering the desired temperament on the input keyboard and pressing the "temper" button. Calculations are then made and the results are stored in RAM. When the user strikes a note on the musical instrument, a value is pulled out of RAM corresponding to the note struck. This value is then multiplied by the octave multiplier in ROM and the tempered note is sounded. This is all done using MIDI messages within a fraction of a second.

The use of the meantone temperer will benefit the user in a number of ways:

1. Users can very quickly change from one temperament to another. This will allow the user to eliminate the wasting of expensive studio time and will also create a delay-free performance when using the meantone temperer during a live show.
2. Users can experiment with different intonations.
3. Users will be able to hear classical compositions exactly as they sounded when the composer wrote them. Since the meantone temperer is a MIDI device, it can be used along with other MIDI devices in a network.

Figure 1:
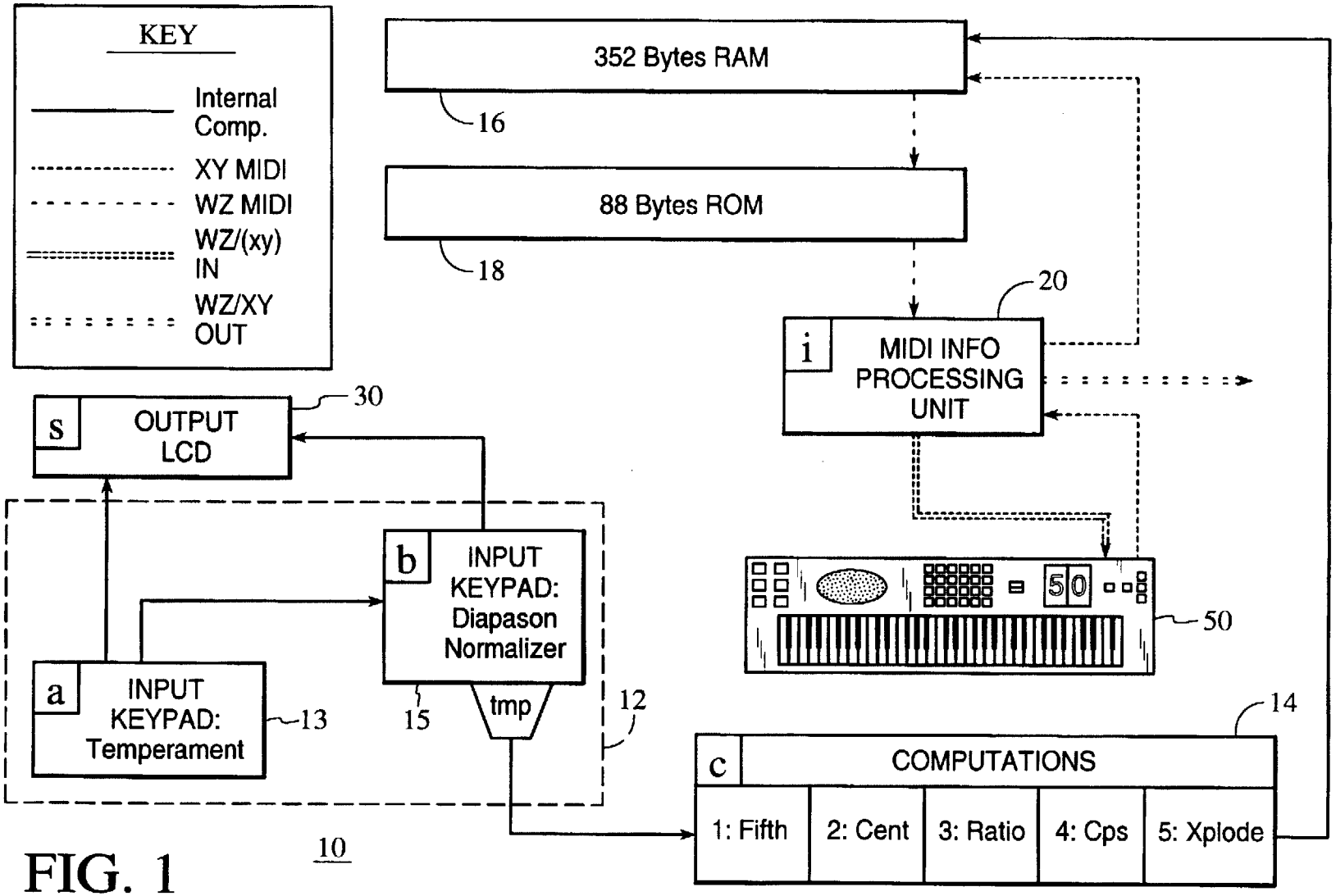
FIG. 1 is a first embodiment of a meantone temperament system in accordance with the present invention.

Referring now to FIG. 1, what is seen is a meantone temperer 10 in accordance with the present invention that can be utilized in conjunction with a MIDI device 50. The meantone temperament system 10 includes an input keypad system 12 which is coupled to a meantone computation system 14. The computation system 14 in turn is coupled to a first memory 16 which receives exploded computations from the computation system 14. The first memory 16 is coupled to a second memory 18 for multiplexing the octave level of the exploded computations. The meantone temperer 10 also includes a MIDI processing unit 20 which receives tonal signals from the MIDI device 50. The processing unit 20 sends and receives data from the first and second memory. Each of these components will be described in more detail hereinbelow.

Input Keypad 12

The input keypad includes two components, a temperament component 13 and a normalizer component 15. The temperament component is one in which the desired temperament is entered. This desired temperament can be entered in a variety of ways. Then the correct pitch is entered by a normalizer. This pitch can be provided in a variety of ways. Next, these two inputs are then used to compute the proper meantone temperament. Both of these inputs can optionally be viewed on the output LCD 30.

Computation System 14

Figure 2:
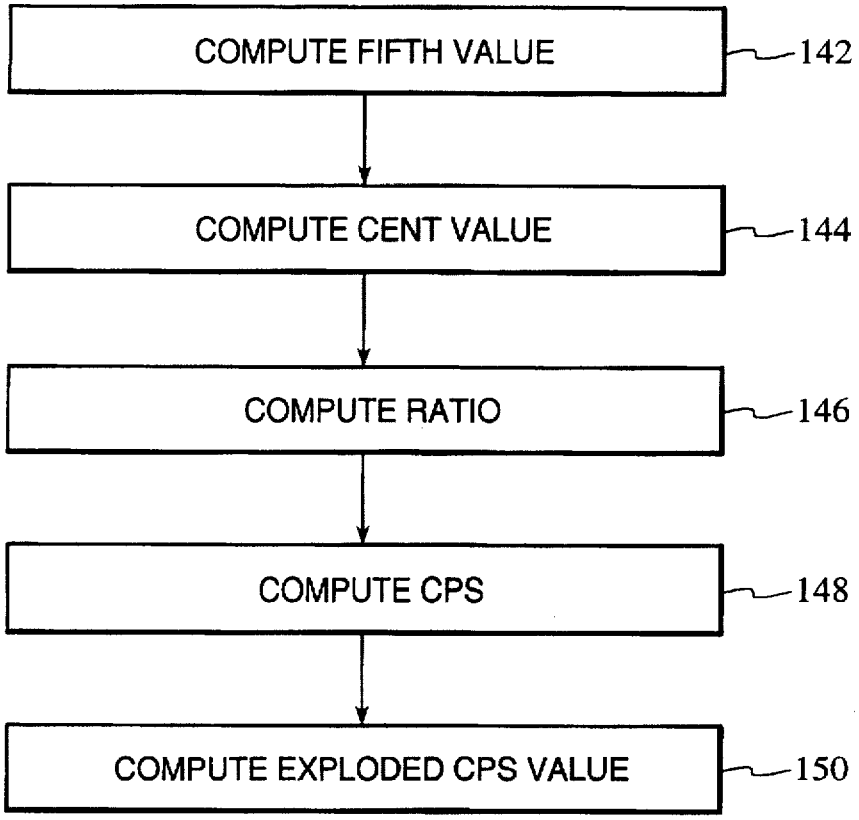
FIG. 2 is a flow chart showing the operation of the computation system of the meantone temper of FIG. 1.

The computation system 14 receives the inputs from the input keypad 12 to compute the proper meantone temperament for the device 50. Referring now to FIG. 2, what is shown is a flow chart of the operation of the computation system 14. Accordingly, as is seen, initially a fifth value is computed via step 142. The value is then utilized to compute the appropriate cent value, via step 144. The cent value for each scale degree are computed in accordance with a meantone temperament procedure.

To more particularly describe such a procedure, refer to the following discussion which explains the proper procedure for finding the thirteen chromatic notes of a given meantone-tempered scale. Starting with a circle root (CRT), the cent value of the tempered fifth (f) is added to the value of CRT, which yields the value of one of the notes in the desired (user-selected) meantone scale. Then, f is added to this sum (CRT+f), which yields the value of another note in the desired meantone scale. Then, f is added once again to this new sum (CRT+f+f), which yields yet another note in the desired meantone scale. This cyclic addition procedure is used for the desired (user-selected "cyclic steps upwards." Counting the addition of f to the initial CRT as the first step, this addition procedure is carried out (cycled) for the amount of user-selected "cyclic steps upwards."

This same basic procedure is performed again, although this time subtracting the tempered fifth (f) cyclically from the initial circle root (CRT). This time, however, it is repeated in order to carry out the user-selected "steps downwards." After this downward (subtraction) process is completed, the note values obtained from both the addition process and the subtraction process will equal thirteen notes (number of notes in a chromatic scale). The first twelve of these thirteen note values (C to B) are the values used by the meantone temperament system to temper the connected musical instrument.

Thereafter, a ratio is computed from the cent values, via step 146. Finally, the cycles per second are computed from the ratio, via step 148. This cycle per second information is utilized to determine the meantone temperament of the particular song to be played. To convert this cycle per second frequency into a unit that can be digitally utilized an explode is required such that the tempered base frequencies are separated into whole number units, via step 150.

For example, if the cycle per second is 100.265 cps, then the exploded cycle per second to be utilized in digital format would require 100 to be sent first in one memory location, next the 2 which represents two tenths in a second memory location, next the 6 which represents six one-hundredths in a third memory location, and 5 which represents five one-thousandths in the fourth memory location. This separation is necessary because only integers not factors can be stored in the location. More importantly, the digital values are necessary in order to provide the proper tonal information to MIDI device.

RAM 16

First memory or RAM 16 comprises a plurality of bytes, typically, in a preferred embodiment in the case of a piano, 352 bytes, four bytes for each piano key. The RAM 16 receives the stored tempered base frequencies in exploded form.

ROM 18

ROM 18 second memory or ROM 18, consists of eighty-eight bytes, one for each piano key. The ROM 18 is used to store octave multipliers, and the octave multipliers are used in turn to multiply the notes from RAM 16 by a particular octave.

MIDI Processing Unit 20

The function of the processing unit 20 is to process, relay and route information to and from the MIDI Device 50 and to and from other connected musical devices.

Accordingly, the present invention operates in the following manner:

By entering desired temperament and normalizer on the input keypad and pressing the temper button, calculations are then made by the computation means system and the results are stored in the RAM. When the user strikes a note on the musical instrument, a value is pulled out of the RAM corresponding to the note struck by the info processing unit. This value is then multiplied by the octave multiplier in ROM and the tempered note is sounded. Through the operation of the present invention, a user can quickly change from one temperament to another.

Figure 3:
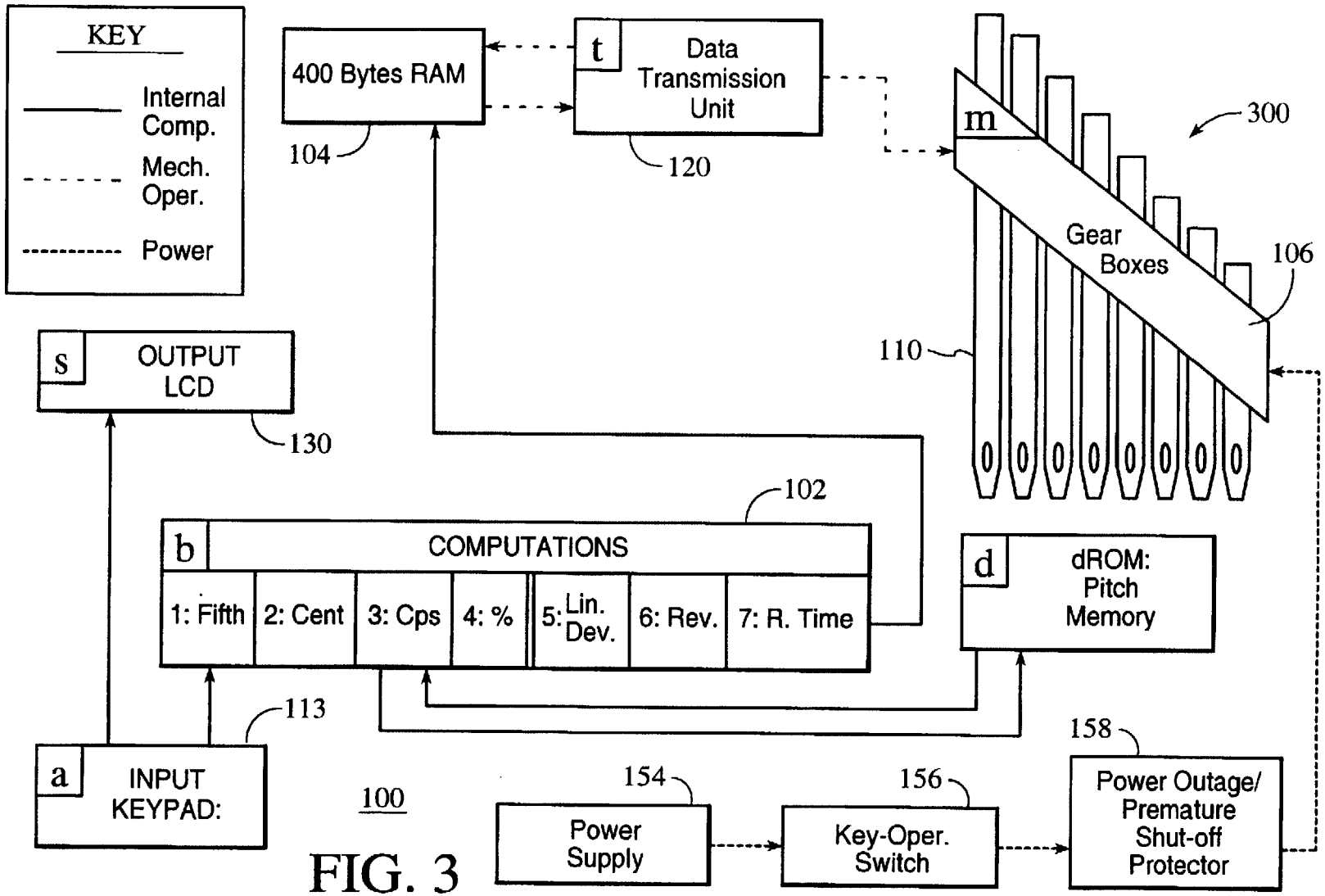
FIG. 3 is a second embodiment of a meantone temperament system in accordance with the present invention.

The present invention can be utilized in a variety of instruments and is not limited to a MIDI device. Referring now to FIG. 3, another embodiment of a meantone temperament system 100 for telescoping organ pipes is used to temper a pipe organ 300 to a desired meantone-tempered scale, which is selected by the user. The system 100 is powered by a power supply 154 which is activated by a switcher 156 (key operated) in this embodiment. In a preferred embodiment, the system would include a power outage/premature shutoff protector 158. This system 100 is operated by simply entering the desired temperament on the input keypad 113 and pressing the "temper" button similar to that shown in FIG. 1. Calculations are then made in computation system 102 and the results are stored in RAM 104. These values are then sent to gearboxes 106 connected to each set of organ pipes 108 in order to determine how many seconds the gears are to rotate in order to telescope the pipe extensions 110 to the correct settings. When all the extensions 110 are telescoped, the user may play the organ 300 which will reflect the new temperament. Because of the analogue movements, the user must wait a little while longer when using the meantone temperer 100 for a pipe organ 300 than when using a MIDI musical instrument as described in relationship to FIG. 1. However, this short wait comes only during the initial mechanical movement of the pipe extensions 110 via data transmission unit 120. When temperament is finished, the organ 300 will play exactly as before; only the lengths of the pipes have been altered.

Accordingly, the use of the meantone temperer will benefit the user in a number of ways:

1. Users can very quickly change from one temperament to another without interrupting or delaying a concert or church service. This will also eliminate the wasting of expensive studio time when making full pipe organ recordings.
2. Users can experiment with different intonations.
3. Users will be able to hear classical compositions exactly as they sounded when the composer wrote them.

The meantone temperer telescoping organ pipes system requires virtually no cosmetic alteration to the existing layout of the church or cathedral in which it will be used. Cosmetic alterations would be necessary only if the church or cathedral has pipes that are visible from the sanctuary; even then this alteration would be virtually unnoticeable. This should be a very positive point when selling this system to a prospective buyer.

Accordingly, the present invention provides for tuning an instrument in accordance with a meantone. The system can be utilized with a variety of instruments and can adaptably adjust the tuning of the instrument in accordance with a particular meantone reliably and easily.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A system for tuning a musical instrument to a meantone temperament comprising:

an input key pad for providing a desired meantone temperament indication;

a computation means for receiving the desired temperament indication and for calculating and transmitting exploded digital data representative of a desired meantone temperament;

a memory means for receiving the exploded data from the computation means; and a processing unit coupled to the memory means and the musical instrument for processing, relaying and routing the exploded data to and from the musical instrument.

2. The system of claim 1 in which the input key pad is also for providing a pitch to the computation means.

3. The system of claim 1 in which the musical instrument comprises a MIDI device.

4. The system of claim 3 in which the memory means further comprises:

a first memory for receiving the exploded data from the computation means; and a second memory for receiving octave information from the MIDI device via the processing unit; the first and second memories for providing digital information representing the meantone temperament to the MIDI device.

5. The system of claim 1 in which the musical instrument comprises an organ.

6. The system of claim 1 in which the computation means further comprises:

first means for computing a fifth value;

second means responsive to the first means for computing a cent value in accordance with a meantone temperament procedure;

third means responsive to the second means for computing ratio from cent;

fourth means responsive to the third means for computing cycles per second (CPS) of the meantone temperament; and fifth means responsive to the fourth means for computing an exploded CPS value.

7. A method for tuning a musical instrument to a meantone temperament comprising:

a) providing a desired meantone temperament indication;

b) receiving the desired temperament indication and for calculating and transmitting exploded digital data representative of a desired meantone temperament;

c) receiving the exploded data; and d) processing, relaying and routing the exploded data to and from the musical instrument.

8. The method of claim 7 in which the providing step (a) also includes the step of providing a pitch indication.

9. The method of claim 7 in which the musical instrument comprises a MIDI device.

10. The method of claim 9 in which the exploded data receiving step (c) further comprises:

c1) receiving the exploded data from the computation means; and c2) receiving octave information from the MIDI device via the processing unit; and c3) providing digital information representing the meantone temperament to the MIDI device.

11. The method of claim 7 in which the musical instrument comprises an organ.

12. The method of claim 7 in which the receiving step (b) further comprises:

b1) computing a fifth value;

b2) computing a cent value in accordance with a meantone temperament procedure;

b3) computing ratio from cent;

b4) computing cycles per second (CPS) of meantone temperament; and b5) computing an exploded CPS value.

13. A system for tuning a musical instrument to a meantone temperament comprising:

an input key pad for providing a desired meantone temperament indication;

a computation means for receiving the desired temperament indication and for providing exploded digital data representative of the desired meantone temperament;

the computation means further comprising: first means for computing a tempered fifth value; second means responsive to the first means for computing cent values in accordance with a meantone temperament procedure; third means responsive to the second means for computing ratios from the cent values; fourth means responsive to the third means for computing cycles per second (CPS) values of the meantone temperament; and fifth means responsive to the fourth means for computing exploded CPS values;

a memory means for receiving the exploded data from the computation means; and a processing unit coupled to the memory means and the musical instrument for processing, relaying and routing the exploded data to and from the musical instrument.

14. A method for tuning a musical instrument to a meantone temperament comprising:

a) providing a desired meantone temperament indication;

b) receiving the desired temperament indication and for providing exploded digital data representative of the desired meantone temperament; the receiving step (b) further comprising (b1) computing a tempered fifth value;

(b2) computing cent values in accordance with a meantone temperament procedure;

(b3) computing ratios from the cent values;

(b4) computing cycles per second (CPS) values of the meantone temperament; and (b5) computing exploded CPS values;

c) receiving the exploded digital data; and d) processing, relaying and routing the exploded digital data to and from the musical instrument.

15. The system of claim 5 which further includes a set of organ pipes and the organ pipes including extension portions; a plurality of gear boxes coupled to the extension portions; and a data transmission unit coupled between the plurality of gear boxes and the memory means for causing the extension portions to move to the correct settings.

16. The system of claim 5 which further includes a switching means coupled to a power supply for providing power to the plurality of gear boxes and a power outage/premature shut-off protector coupled to the plurality of gear boxes.

* * * * *